US009750285B2

(12) United States Patent
Davis

(10) Patent No.: US 9,750,285 B2
(45) Date of Patent: Sep. 5, 2017

(54) SHIRT COLLAR LOCKING SYSTEM AND APPARATUS

(71) Applicant: Bryan Davis, New York, NY (US)

(72) Inventor: Bryan Davis, New York, NY (US)

( * ) Notice: Subject to any disclaimer, the term of this patent is extended or adjusted under 35 U.S.C. 154(b) by 234 days.

(21) Appl. No.: 14/744,733

(22) Filed: Jun. 19, 2015

(65) Prior Publication Data

US 2016/0088876 A1 Mar. 31, 2016

Related U.S. Application Data

(60) Provisional application No. 62/057,031, filed on Sep. 29, 2014.

(51) Int. Cl.
*A41B 3/06* (2006.01)

(52) U.S. Cl.
CPC ..... *A41B 3/06* (2013.01)

(58) Field of Classification Search
CPC ..... A41B 3/06; A41B 1/08
USPC ..... 2/60, 127, 129, 132, 116, 117
See application file for complete search history.

(56) References Cited

U.S. PATENT DOCUMENTS

| | | | | |
|---|---|---|---|---|
| 1,414,119 | A | 4/1922 | Feigenbaum | |
| 1,427,727 | A | 8/1922 | Fairless | |
| 1,826,176 | A | 10/1931 | Hutchison | |
| 1,845,884 | A | 2/1932 | Marinsky | |
| 2,014,952 | A | 9/1935 | Robbins | |
| 2,031,776 | A * | 2/1936 | Honigsberg | A41B 3/06 2/132 |
| 2,324,617 | A | 7/1943 | Des Jardins | |

(Continued)

FOREIGN PATENT DOCUMENTS

| | | |
|---|---|---|
| CN | 102920029 A | 2/2013 |
| GB | 453537 A | 9/1936 |

OTHER PUBLICATIONS

Dress Codes: Trying to Keep Tieless Looking Tireless; Coleman David; New York Times; New York, NY; Nov. 7, 2004; 2 pages.

(Continued)

*Primary Examiner* — Gloria Hale
(74) *Attorney, Agent, or Firm* — Cowan, Liebowitz & Latman P.C.

(57) ABSTRACT

A shirt collar locking system for locking a shirt collar in an upright position adapted for use with a stick-shaped collar stay having a first end and an opposing second end, the system comprising a shirt collar attached to a collar stand at an upper portion of the collar stand, an inner side of the shirt collar facing an outer side of the collar stand when the shirt collar is in a folded down position relative to the collar stand, wherein: the shirt collar includes a shirt collar stay pocket formed on the inner side of the shirt collar and configured to receive the first end of the collar stay, the collar stand includes a collar stand receiving portion formed on the outer side of the collar stand and configured to receive the opposing second end of the collar stay so as to lock the shirt collar to the collar stand, and when the shirt collar is in a folded down position relative to the collar stand, a first end of the shirt collar stay pocket adapted for insertion of the first end of the collar stay is aligned with and proximate to a first end of the collar stand receiving portion adapted for insertion of the second end of the collar stay.

22 Claims, 8 Drawing Sheets

(56) References Cited

U.S. PATENT DOCUMENTS

| | | | | | |
|---|---|---|---|---|---|
| 2,431,053 | A | * | 11/1947 | Less | A41B 3/06 2/132 |
| 2,439,088 | A | | 4/1948 | Herr | |
| 3,060,447 | A | | 10/1962 | Dethier | |
| 4,118,803 | A | | 10/1978 | Blau | |
| 4,286,337 | A | * | 9/1981 | Malouf, Jr. | A41B 3/06 2/116 |
| 4,975,983 | A | * | 12/1990 | Everett | A44C 25/00 2/60 |
| 7,409,730 | B2 | | 8/2008 | Boos | |
| 8,296,865 | B2 | * | 10/2012 | Garcia | A41B 3/06 2/117 |
| 8,479,317 | B2 | * | 7/2013 | Nguyen | A41B 1/08 2/117 |
| 2011/0113526 | A1 | | 5/2011 | Harris | |
| 2014/0041093 | A1 | | 2/2014 | Korobkin | |
| 2014/0090152 | A1 | | 4/2014 | Fernandez | |

OTHER PUBLICATIONS

Style & Travel: The New Old-School Golf Shirt; Ellen Byron; The Wall Street Journal; New York, NY; Feb. 25, 2015; 3 pages.

The above references were cited in a PCT International Search Report dated Jan. 7, 2016, that issued in the corresponding International Application No. PCT/US15/52596.

* cited by examiner

SHIRT COLLAR LOCKING SYSTEM AND APPARATUS

CROSS-REFERENCE TO RELATED APPLICATION

This application claims priority under 35 U.S.C. 119(e) to U.S. Provisional Patent Application No. 62/057,031, filed on Sep. 29, 2014 the entire content of which is incorporated herein by reference.

BACKGROUND OF THE INVENTION

The present invention relates generally to a shirt with a collar and, in particular, to a shirt collar locking system and apparatus.

A button-down shirt generally includes a collar that wraps around the circumference of an individual's neck. The portion of the shirt that contacts the individual's neck and connects a body of the shirt to the collar is referred to as a collar stand. Without the use of a neck tie or the top button being fastened, collars on dress and casual shirts tend to collapse away from the collar stand causing the ends of the collar to spread apart, fall away from the neck, and look untidy. A freshly starched collar will remain neatly positioned on the individual's neck, however, after prolonged use, the collar loses stiffness, curls up, and spreads apart.

FIG. 1 shows a front view of a conventional button-down shirt 10. The shirt 10 includes a shirt collar 15, a collar stand 20 that connects the shirt collar to a body of the shirt, sleeves 25 and buttons 30. FIG. 2 shows a perspective view of an illustrative conventional stick-shaped collar stay 35 used for keeping the shirt collar 15 straight. The collar stay 35 includes a first end 40 and a second end 45. The first end 40 is generally pointed in shape, to match the shape of a pointed tip of the shirt collar. The second end 45 is generally rounded in shape. In order to keep the collar from bending or losing a straight and tidy appearance, the individual can insert the collar stay 35 into a pocket disposed on an inner side of the shirt collar 15. The collar stay 35, when inserted into the pocket, does not contact any other component of the shirt 10.

In order to help the shirt collar maintain a tidy appearance, various technologies have been employed. Buttons placed in appropriate places on the body of the shirt have been used to fasten to the points of the shirt collar in order to keep the collar at a fixed position relative to the body of the shirt. Even with such buttons, however, the shirt collar may still fall away from the collar stand and bow out. Also, buttons are visible when viewing the front of the shirt, potentially resulting in an undesired style or undesired aesthetic appearance.

Snaps and/or buttons may be placed behind the collar that are not visible when viewed from the front of the shirt. However, the snaps and/or buttons are also placed at the point of the collar resulting bowing out of the collar. In addition, because the snaps are not flat and are permanently attached to the collar and the shirt body, and ironing the shirt and the collar over the snaps is difficult and can leave unsightly bumps and/or indentations in the fabric.

Sewing the top of the collar to the collar stand provides a permanent solution, but does not allow for a tie to be worn with the shirt because it cannot be threaded under the collar.

Magnets may be placed inside the shirt and on the collar causing the collar and the shirt to stick together. However, the magnets tend to fall off and get lost since they are not a permanent part of the shirt.

Finally double sided adhesive material purchased separately from the shirt may be placed between the collar stand and the underside of the collar, sticking the two parts of the shirt together. The adhesive material is not a permanent part of the shirt and only lasts a couple of uses until it has to be discarded. In addition, when the material is taken off the shirt, some of the adhesive may remain on the shirt, thus, causing damage to the fabric of the shirt.

SUMMARY OF THE INVENTION

It is an objective of the present invention to provide a shirt collar locking system and apparatus that maintains an upright position of a shirt collar while being invisible when viewed from the front of a shirt.

It is also an objective of the present invention to provide a shirt collar locking system and apparatus that is permanently integrated into a shirt, can be used with a conventional collar stay and does not impede ironing of the shirt or restrict an individual from wearing a tie.

The above and other objectives of the invention are achieved by a shirt collar locking system for locking a shirt collar in an upright position adapted for use with a stick-shaped collar stay having a first end and an opposing second end. The system comprises a shirt collar attached to a collar stand at an upper portion of the collar stand, an inner side of the shirt collar facing an outer side of the collar stand when the shirt collar is in a folded down position relative to the collar stand, wherein the shirt collar includes a shirt collar stay pocket formed on the inner side of the shirt collar and configured to receive the first end of the collar stay, the collar stand includes a collar stand receiving portion formed on the outer side of the collar stand and configured to receive the opposing second end of the collar stay so as to lock the shirt collar to the collar stand, and when the shirt collar is in a folded down position relative to the collar stand, a first end of the shirt collar stay pocket adapted for insertion of the first end of the collar stay is aligned with and proximate to a first end of the collar stand receiving portion adapted for insertion of the second end of the collar stay.

In the shirt collar locking system, the first end of the shirt collar stay pocket is disposed at a predetermined distance from an upper edge of the shirt collar attached to the upper portion of the collar stand, with the predetermined distance being equal to or greater than a distance between the upper portion of the collar stand and the first end of the collar stand receiving portion. In some embodiments, the predetermined distance is substantially mid-way between the upper edge of the shirt collar and an opposing lower edge of the shirt collar.

In some configurations of the locking system, a second end of the shirt collar stay pocket is disposed at a tip of the shirt collar. The shirt collar stay pocket may be separately formed from the shirt collar and attached to the inner side of the shirt collar. The collar stand receiving portion may be separately formed from the collar stand and attached to the outer side of the collar stand. In certain embodiments, the shirt collar comprises two or more layers of material, and the shirt collar stay pocket includes an opening formed at the inner side of the shirt collar and extending through at least one layer of material, the opening forming the first end of the shirt collar stay pocket.

In certain embodiments, the collar stand receiving portion is formed as an elongated pocket with the first end of the collar stand receiving portion formed at between a lower portion of the collar stand and the upper portion of the collar stand and the elongated pocket extending in a direction of the upper portion of the collar stand. In other embodiments, the collar stand receiving portion is formed as a loop on the outer side of the collar stand. In other embodiments, the first end of the collar stand receiving portion may be formed as a pocket or as a loop at any location between the lower portion and the upper portion of the collar stand, such as at a mid-way location between the lower portion and the upper portion of the collar stand. In yet another embodiment, the collar stand is formed from two or more layers of material and the collar stand receiving portion is formed as an opening at a lower portion of the collar stand or about midway between a lower portion and the upper portion of the collar stand and extending through at least an outermost layer of the collar stand.

When the first end of the collar stay is inserted into the shirt collar stay pocket and the second end of the collar stay is inserted into the collar stand receiving portion, the shirt collar stay pocket and the collar stand receiving portion are oriented to be substantially linearly aligned with respect to one another.

In some embodiments, the system further comprises the stick-shaped collar stay and the first end of the collar stay is inserted into the first end of the shirt collar stay pocket and permanently attached to the shirt collar, while the second end of the collar stay is configured to be removably inserted into the first end of the collar stand receiving portion.

A method of manufacturing a shirt including a collar stand and a shirt collar attached to the collar stand and further including a shirt collar locking system for locking the shirt collar in an upright position adapted for use with a stick-shaped collar stay having a first end and an opposing second end, is also disclosed. The method comprises providing a collar stand and a shirt collar, attaching the shirt collar to the collar stand at an upper portion of the collar stand, an inner side of the shirt collar facing an outer side of the collar stand when the shirt collar is in a folded down position relative to the collar stand, forming the shirt locking system by providing a shirt collar stay pocket on the inner side of the shirt collar and providing a collar stand receiving portion on the outer side of the collar stand, wherein the shirt collar stay pocket is configured to receive the first end of the collar stay and the collar stand receiving portion is configured to receive the opposing second end of the collar stay so as to lock the shirt collar to the collar stand, and wherein when the shirt collar is in a folded down position relative to the collar stand, a first end of the shirt collar stay pocket adapted for insertion of the first end of the collar stay is aligned with and proximate to a first end of the collar stand receiving portion adapted for insertion of the second end of the collar stay.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

As stated above, without the use of a neck tie or the top button being fastened, collars on dress and casual shirts tend to collapse away from the collar stand causing the collar to spread open, fall away from the neck, and look untidy. While collar stays may be used to keep a collar straight, collar stays do not keep the shirt collar upright.

According to the shirt collar locking system and apparatus described in more detail below, by shortening a collar stay pocket on the shirt collar, providing a receiving portion on the collar stand, and simultaneously inserting a single stick-shaped collar stay into both the shirt collar and the collar stand, the shirt collar is coupled to the collar stand preventing the collapse and spread of the shirt collar away from the collar stand. The shirt collar locking apparatus is built into the shirt such that the shirt collar locking apparatus is not visible and allows for the shirt to be worn with or without a tie. The collar stays used in the shirt collar locking system and apparatus are removable so that the shirt collar and the collar stand can be ironed flat. When the collar stay is inserted into the shirt collar and the collar stand, the collar stay keeps the shirt collar stiff, straight, and upright. The shirt collar is coupled to the collar stand using the collar stay near a midpoint of the shirt collar, and thus, the shirt collar remains upright and does not bow out.

Figure 1:
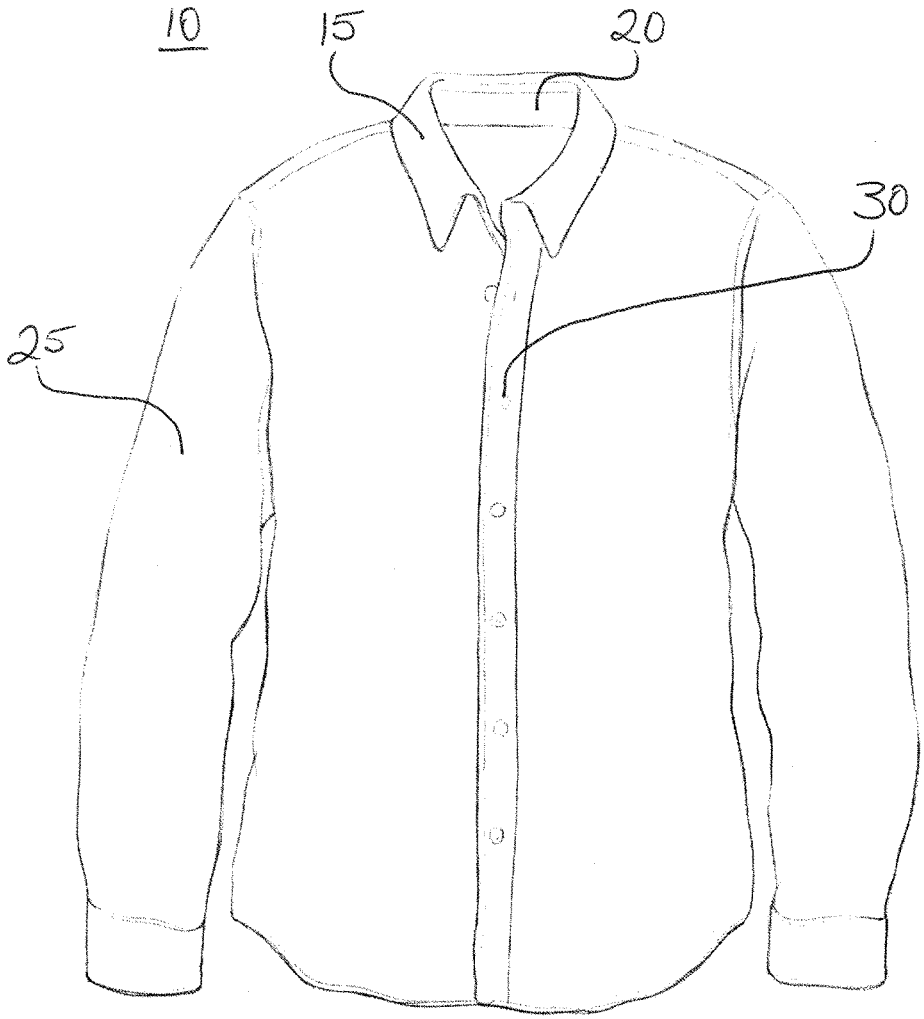
FIG. 1 shows a front view of a button-down shirt.
Figure 2:
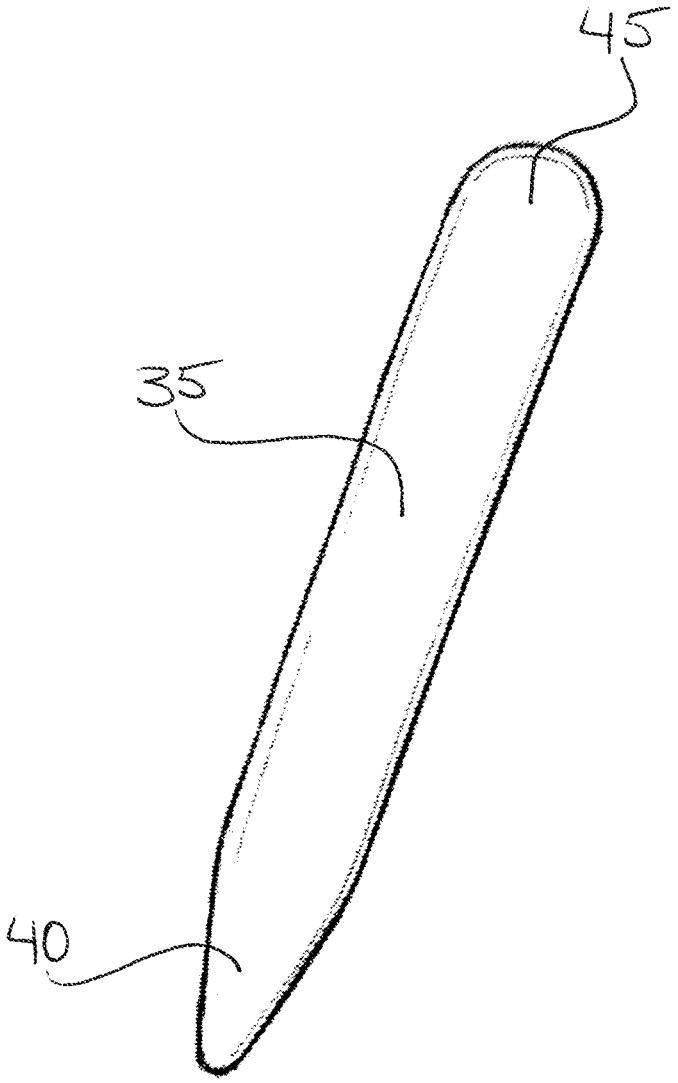
FIG. 2 shows a perspective view of a collar stay used for keeping a collar straight.
Figure 3:
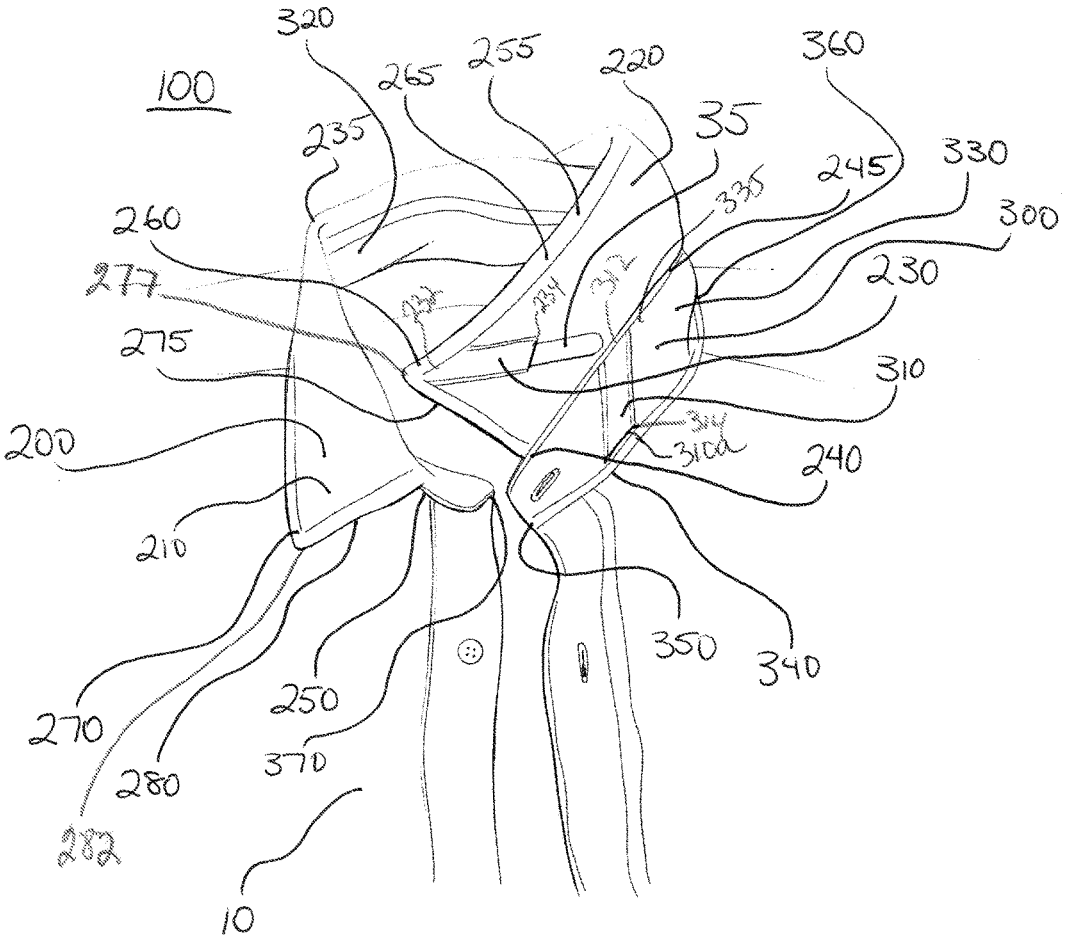
FIG. 3 shows a front view of a shirt collar locking apparatus and system configured to receive a collar stay and lock a shirt collar to a collar stand.

FIG. 3 shows a front view of a first embodiment of the shirt collar locking apparatus and system 100 configured to receive a stick-shaped collar stay 35 and lock a shirt collar to a collar stand so as to keep the shirt collar upright without the use of a tie. The collar stay 35 includes a first end 40 and a second end 45, as illustrated in FIG. 2. The shirt collar locking apparatus 100 includes a shirt collar 200, which has an outer side 210 and an inner side 220. In FIG. 3, the shirt collar 200 is shown as being half folded up and half folded down, so as to show both the outer side 210 and the inner side 220.

The shirt collar 200 includes an upper portion 235 extending from a first upper end 240 along an upper intermediate edge portion 245 to a second upper end 250. The shirt collar 200 also includes a lower portion 255 extending from a first lower end 260 along a lower intermediate edge portion 265 to a second lower end 270. The shirt collar 200 includes a first side portion 275 extending from first lower end 260 of the lower portion 255 to the first upper end 240 of the upper portion 235 so as to form a pointed tip 277 of the collar. The shirt collar 200 includes a second side portion 280 extending from the second lower end 270 of the lower portion 255 to the second upper end 250 of the upper portion 235 to form a second pointed tip 282 of the collar.

A collar stand 300 is coupled to the shirt collar 200 at the upper portion 235 of the shirt collar. The collar stand 300 includes an inner surface 320 and an outer surface 330 opposing the inner surface 320. The inner surface 320 of the collar stand 310 faces the individual's neck when the individual wears the shirt 10. The outer surface 330 faces the inner side 220 of the shirt collar 200 when the shirt collar 200 is in the folded down position. An upper, lengthwise edge 335 of the collar stand 300 is coupled to the shirt collar 200 along the upper portion 235 from the first upper end 240 to the second upper end 250 of the shirt collar, while an opposing, lower edge 340 of the collar stand 300 is coupled to the shirt 10 from a first bottom edge end 350 along an intermediate bottom edge 360 to a second bottom edge end 370. The collar stand 300 may be attached to the shirt 10 by, for example, stitching or any other suitable means. In some embodiments, the collar stand 300 and the shirt 110 may be formed from one continuous piece of fabric, with the shirt collar 200 separately attached to the collar stand 300 along the upper portion 235. In other embodiments, the shirt collar 200, the collar stand 300, and the shirt 10 may be formed from one continuous piece of fabric.

As shown in FIG. 3, a shirt collar stay pocket 230, configured to receive the first end 40 of the collar stay 35 is provided on the inner side 220 of the shirt collar 200. The shirt collar stay pocket 230 has an elongated shape configured to retain the first end 40 of the collar stay 35 in place. In the illustrative embodiment of FIG. 3, the shirt collar stay pocket 230 is formed by a through opening in one or more layers of material of the shirt collar 200, wherein the one or more layers of material do not include at least the outermost layer of the shirt collar forming the outer side 210 thereof. In this way, the inner side 220 of the shirt collar 200 includes a slit opening at one end 234 of the shirt collar stay pocket 230 for inserting the first end 40 of the collar stay 35, and the collar stay 35 is not visible from the outer side 210 of the shirt collar 200. Stitching around the periphery of the shirt collar stay pocket 230 may be provided in order to guide and orient the first end 40 of the collar stay 35 in the direction of another end 232 of the shirt collar stay pocket 230 which is located at or near the pointed tip of the collar 277. Alternatively, adhesive between certain layers of the shirt collar 200 may be used around the periphery of the shirt collar stay pocket 230. In other embodiments, the shirt collar stay pocket 230 may be separately formed and attached to the surface of the inner side 220 of the shirt collar 200 using stitching, adhesive or other suitable methods.

In some embodiments, the collar stay may be inserted into the shirt collar stay pocket 230 and permanently attached to the shirt collar so that the collar stay would not be removable from the shirt collar stay pocket 230. In such embodiments, the end of the collar stay may be sewn into the shirt collar stay pocket 230, or attached by an adhesive to the collar or by any other suitable means of attachment. The other end of the collar stay which is not inserted into the shirt collar stay pocket 230 is exposed from the inner side of the shirt collar and can be inserted into the collar stand receiving portion 310. This configuration allows the collar stay to remain inserted into the shirt collar so as to keep the shirt collar straight, while also allowing for flexibility of wearing the shirt with a tie or without a tie. When the shirt is worn with a tie, the other end of the collar stay is not inserted into the collar stand receiving portion. However, when the shirt is worn without a tie, the wearer has the option of inserting the other end of the collar stay into the collar stand receiving portion so as to keep the shirt collar locked and upright.

As shown in FIG. 3, the shirt collar stay pocket 230 is configured so that the length of the elongated collar stay pocket is smaller than the length of the collar stay 35. In this way, when the first end 40 of the collar stay is inserted into the shirt collar stay pocket 230, the second end 45 of the collar stay is exposed and can be inserted into a collar stand receiving portion 310 described herein below. In the illustrative embodiment shown in FIG. 3, the length of the shirt collar stay pocket 230 is less than about ⅔ of the length of the collar stay 35, and in some embodiments, about ½ of the length of the collar stay 35. As shown, the shirt collar stay pocket 230 is formed at an angle with respect to the edge formed by the lower portion 255 of the shirt collar 200, preferably at about a 45 degree angle or smaller. Moreover, the shirt collar stay pocket 230 begins at a predetermined distance away from the upper portion 235 of the shirt collar 200 so as to allow for insertion of the collar stay 35 into both the shirt collar stay pocket 230 and the collar stand receiving portion 310. In the embodiment shown, the shirt collar stay pocket 230 begins at about mid-way between the upper portion 235 and the lower portion 245 of the shirt collar. However, the predetermined distance will vary depending on the configuration of the shirt collar and the height of the collar stand relative to the width of the shirt collar. In the configuration of FIG. 3, the predetermined distance is equal to or greater than the height of the collar stand. In any case, the predetermined distance is equal to or greater than a distance between the upper portion of the collar stand and a first end of the collar stand receiving portion 310 adapted for receiving the second end 45 of the collar stay.

As shown, the collar stand receiving portion 310 is disposed on the outer surface 330 of the collar stand 300 and is configured to receive the second end 45 of the collar stay 35. In FIG. 3, the collar stand receiving portion 310 is formed as a sleeve or a pocket with an opening **310*a* at or near the bottom edge 340 of the collar stand. In this illustrative embodiment, the collar stand receiving portion 310 comprises an elongated sleeve or pocket that extends from one end 314 that includes the opening 310*a* at or near the bottom edge 340 of the collar stand to an opposing closed end 312 which is at or near an upper edge 335 of the collar stand 300. The collar stand receiving portion 310 is positioned on the outer side of the collar stand 300 and oriented so that when the shirt collar 200 is folded down, the opening 234 of the shirt collar stay pocket 230 is aligned with and/or proximate to the opening 310*a* of the collar stand receiving portion 310 without overlapping with the collar stand receiving portion 310. In addition, when the shirt collar 200 is folded down, the collar stand receiving portion 310 and the shirt collar stay pocket 230 are oriented so as to be linearly aligned relative to one another. This configuration allows for the linear or substantially linear collar stay 35 to be inserted into both the shirt collar stay pocket 230 and into the collar stand receiving portion 310. The relative proximity between the opening 234 of the shirt collar stay pocket 230 and the opening 310*a* of the collar stand receiving portion 310 may be adjusted so that the collar stay 35 remains inserted into both the shirt collar stay pocket 230 and the collar stand receiving portion 310 without causing excess tugging or pulling on the shirt collar 200 or on the collar stand 300** and without being noticeable or visible from the outside.

Figure 5:
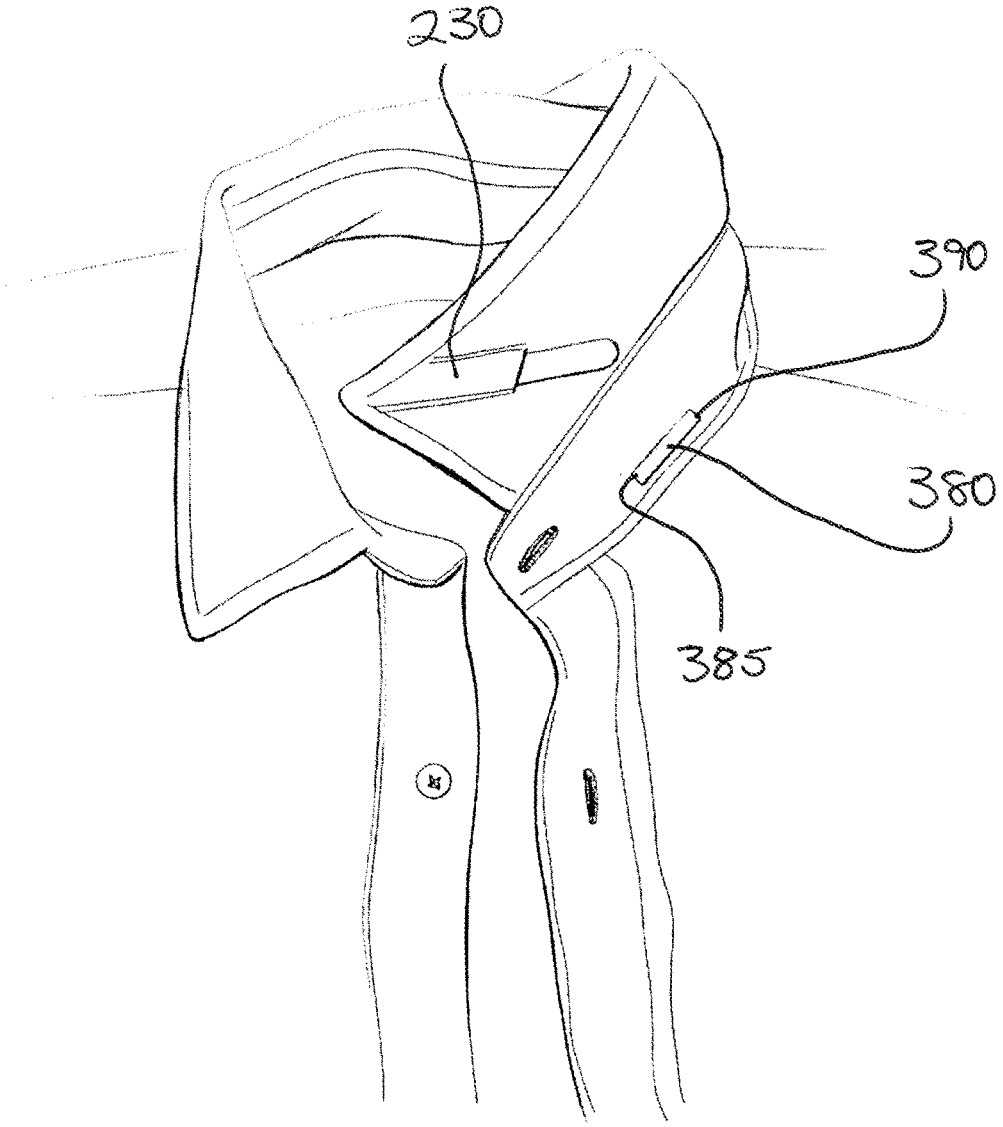
FIG. 5 shows another embodiment of the shirt collar locking apparatus and system with the collar stand receiving portion embodied as a loop with the shirt collar in a half folded up position.
Figure 6:
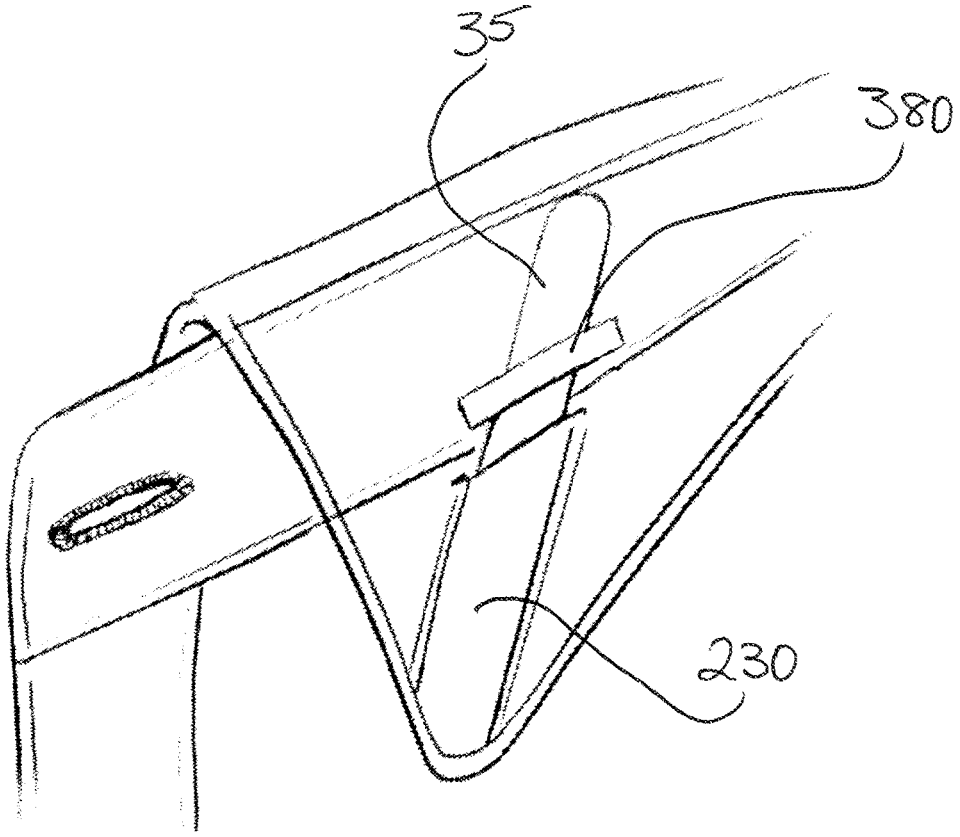
FIG. 6 shows an expanded front view of the shirt collar locking apparatus of FIG. 5 with the collar stay inserted into the shirt collar stay pocket and through the loop with the shirt collar in the folded down position.
Figure 7:
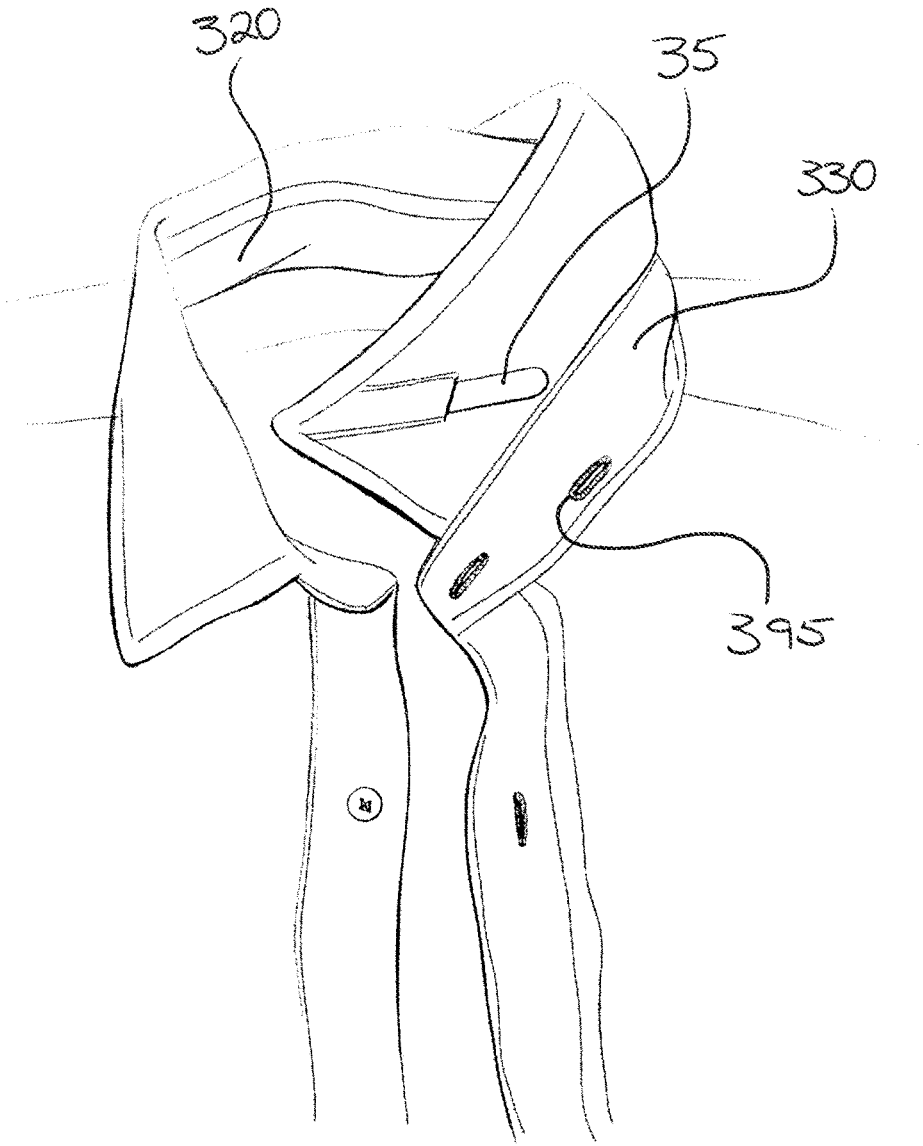
FIG. 7 shows a third embodiment of the shirt collar locking apparatus and system with the collar stand receiving portion embodied as an opening with the shirt collar in the half folded up position.
Figure 8:
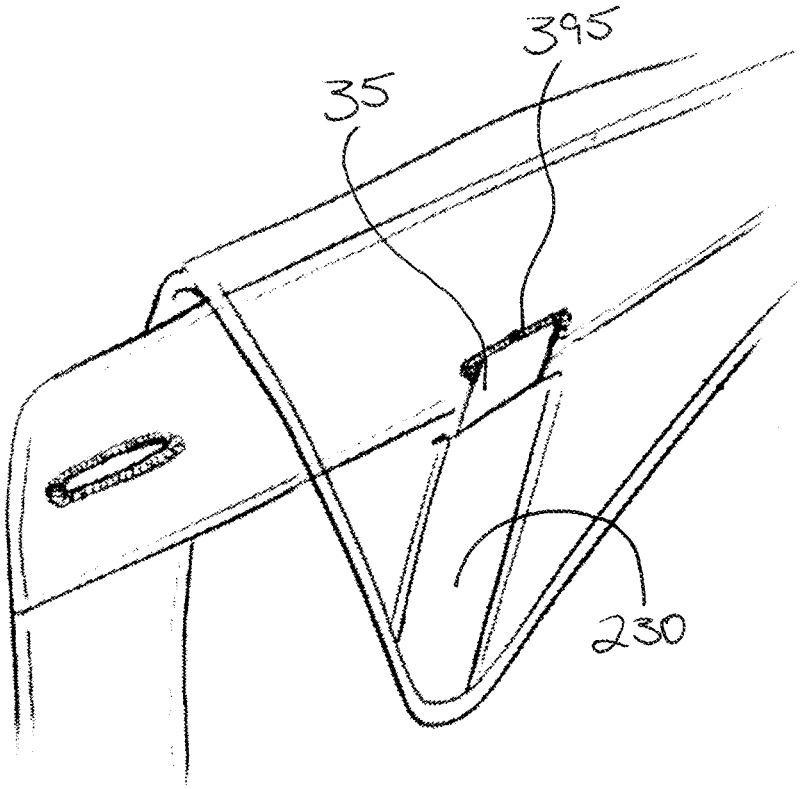
FIG. 8 shows an expanded front view of the shirt collar locking apparatus of FIG. 7 with the collar stay inserted into the shirt collar stay pocket and into the opening with the shirt collar in the folded down position.

As further described herein, the collar stand receiving portion 310 may be a embodied as a loop, as illustrated in FIGS. 5-6, or a through opening in one or more layers of fabric that form the collar stand 300 so as to form an internal pocket, as shown in FIGS. 7-8, or other similar configuration capable of retaining the second end of the collar stay 35. The shirt collar stay pocket 230 and/or the collar stand receiving portion 310 may be constructed of cotton fabric, fabric blend, plastic, silicone or any other suitable material with sufficient flexibility to allow for insertion of the collar stay into both the shirt collar stay pocket 230 and the collar stand receiving portion 310.

With the shirt collar stay pocket 230 and the collar stand receiving portion 310, the shirt collar locking apparatus 100 is configured such that when the first end 40 of the collar stay 35 is inserted into the shirt collar stay pocket 230 and the second end 45 of the collar stay 35 is inserted into the collar stand receiving portion 310, the shirt collar 200 is releasably coupled to the collar stand 300 via the collar stay 35. Furthermore, the shirt collar locking apparatus 100 is configured such that the opening 234 in the shirt collar stay pocket 230 and the opening 310*a* in the collar stand receiving portion 310 are aligned with each other and/or are proximate to one another, and so that the shirt collar stay pocket 230 and the collar stand receiving portion 310 are oriented to be substantially linearly aligned with respect to one another. Moreover, the shirt collar stay pocket 230 and the collar stand receiving portion 310 are oriented and aligned in such a way that when the first end 40 of the collar stay 35 is inserted into the shirt collar stay pocket 230 and the second end 45 of the collar stay 40 is inserted into the collar stand receiving portion 310, the shirt collar 200 remains coupled to the collar stand 300 without being visible from the outside and without causing excess tugging, pulling or bending three on the shirt collar 200 or on the collar stand 300. In this way, when the collar stay 35 is inserted into the shirt collar stay pocket 230 and into the collar stand receiving portion 310, the shirt collar 200 remains straight and upright because the shirt collar 200 is retained against, and engaged with, the collar stand 300.

Figure 4:
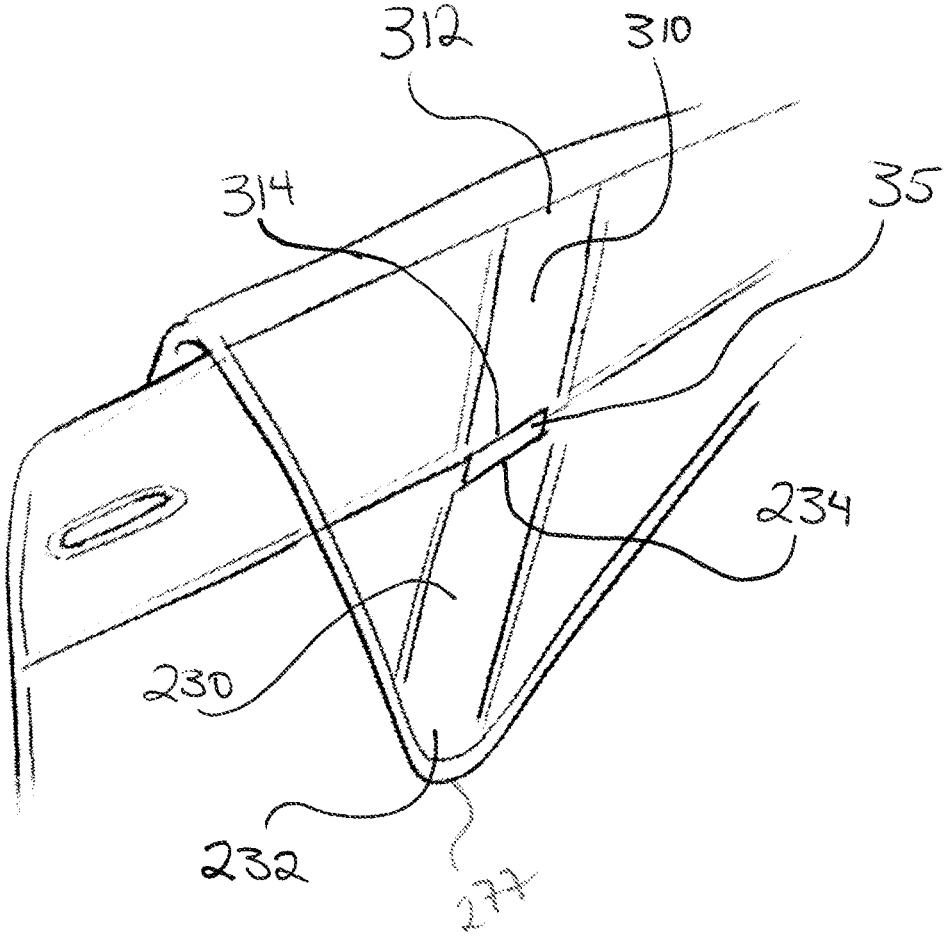
FIG. 4 shows an expanded front view of the shirt collar locking apparatus if FIG. 3 with the collar stay inserted into a shirt collar stay pocket and a collar stand receiving portion with the shirt collar in a folded down position.

FIG. 4 shows an expanded front view of the shirt collar locking apparatus 100 with the collar stay 35 inserted into the shirt collar stay pocket 230 and the collar stand receiving portion 310 and with the shirt collar 200 in the folded down position. For purposes of demonstrating the shirt collar locking apparatus 100, the collar stay 35, the shirt collar stay pocket 230 and the collar stand receiving portion 310 are illustrated in FIG. 4. However, when implemented in a product, these elements are not visible when viewed from the outside.

As shown in FIG. 4, the shirt collar stay pocket 230 includes a first pocket end 234 that is open and a second pocket end 232 that is closed. The second pocket end 232 of the collar stay pocket 230 is located at or near the pointed tip of the collar 277 where the first side portion 275 and the first lower end 260 of the lower portion 255 meet. The first pocket end 234 of the collar stay pocket 230 may be disposed at a distance away from the first side portion 275 and at the predetermined distance away from the upper portion 235 of the shirt collar 200. In the embodiment shown, the predetermined distance from the upper portion 235 of the shirt collar 200 is about mid-way between the upper portion 235 and the lower portion 255 of the shirt collar 200. The predetermined distance may vary depending on the dimensions of the shirt collar 200 and of the collar stand 300. As discussed above, the predetermined distance for the positioning of the first pocket end 234 of the shirt collar stay pocket 230 is preferably equal to or greater than a distance between the upper portion of the collar stand and a first end 314 of collar stand receiving portion 310. That is, the first end 234 is positioned so that the shirt collar stay pocket 230 does not extend to overlap with the collar stand 300 when the shirt collar is in the folded down position. As discussed above, the shirt collar stay pocket 230 extends at an angle with respect to the lower portion 255 of the shirt collar 200, which is preferably about 45 degrees or smaller. The length of the shirt collar stay pocket 230 between the first and second ends 234, 232 is such that the collar stay 35 can be inserted into the shirt collar stay pocket 230 and remain inserted without falling out while also maintaining the shape of the shirt collar. Moreover, the length of the shirt collar stay pocket 230 is such that the collar stay 35 will remain inserted in the shirt collar stay pocket 230, without additional retaining means, even if the other end of the collar stay is not inserted into the collar stand receiving portion 310. This allows for versatility in wearing the shirt with or without a tie, so that when the wearer wishes to put on a tie, the wearer can remove the second end of the collar stay from the collar stand receiving portion 310 and put on a tie while also retaining the collar stay in the collar stay pocket 230.

Although not shown, the other side of the shirt collar includes a similar shirt collar stay pocket for inserting another collar stay. In some embodiments the shirt collar may include multiple shirt collar stay pockets 230 having like configurations and disposed at various positions along the shirt collar 200.

As shown in FIG. 4, the collar stand receiving portion 310 includes the first end 314 which is open and a second end 312 which is closed. The first end 314 is provided at or near the bottom edge 340 of the collar stand and the collar stand receiving portion 310 extends in a substantially linear direction to the opposing second end 312 which is provided at or near the upper edge 335 of the collar stand 300 near the upper portion 235. The positioning of the first and second ends 314, 312 relative to the bottom edge 340 and the upper edge 335 of the collar stand may vary depending on the height of the collar stand 300, the length of the collar stay 315 and the desired alignment with the shirt collar stay pocket 230.

Although not shown in FIG. 4, the other side of the shirt collar includes a similar collar stand receiving portion fir inserting another collar stay. In some embodiments, multiple collar stand receiving portions may be provided at various positions along the collar stand 300 and in corresponding alignment with corresponding multiple shirt collar stay pockets.

FIGS. 5 and 6 shows an alternative embodiment of the shirt locking apparatus 100 in which the collar stand receiving portion 310 comprises a loop 380 provided in a predetermined position on the outer surface of the collar stand 300. In FIG. 5, the shirt collar 200 is shown in the half folded up position for ease of illustration. FIG. 6 shows an expanded front view of the shirt collar locking apparatus 100 with the collar stay 35 inserted into the shirt collar stay pocket 230 and through the loop 380 with the shirt collar 200 in the folded down position. In FIG. 6, the shirt collar stay pocket 230, the loop 380 and the collar stay are shown for illustrative purposes and it is understood that these elements would not be visible from the outside in the actual product.

As shown, the loop 380 comprises a piece of material which is attached to the collar stand at a first end 385 and a second end 390. The loop 380 may be made from any suitable material, including fabric, plastic, metal and the like. The first and second ends 385, 390 of the loop 380 are attached to the outer surface 330 of the collar stand 300 by, for example, stitching, bonding using adhesives, a variety of fasteners, including snaps, posts, prongs, etc., or any other suitable attachment means, In this configuration, the second end 45 of the collar stay 35 is inserted through the loop 380, between the first and second ends 385, 390, and rests on the outer surface 330 of the collar stand 300. The positioning of the loop 380 relative to the upper and bottom edges of the collar stand may be varied. In the embodiment shown in FIG. 5, the loop 380 is provided near the bottom edge 340 of the collar stand. However, in other embodiments, the loop may be provided mid-way between the bottom edge 340 and the upper edge 335 of the collar stand 300, or closer to the upper edge of the collar stand. Moreover, the positioning of the loop 380 along the length of the collar stand 300 is selected so that when the shirt collar 200 is in a folded down position, the loop 380 aligns with the opening end 234 of the shirt collar stay pocket 230 to allow for insertion of the collar stay into both the shirt collar stay pocket 230 and into the loop 380.

FIGS. 7 and 8 show another embodiment of the shirt locking apparatus 100 in which the collar stand receiving portion 310 is formed as a through opening or a partially through opening 395 within the collar stand 300. FIG. 7 shows the shirt collar 200 in the half folded up position, while FIG. 8 shows an expanded front view of the shirt collar locking apparatus 100 with the collar stay 35 inserted into the shirt collar stay pocket 230 and through the opening 395 with the shirt collar 200 in the folded down position. In FIG. 8, the shirt collar stay pocket 230, the opening 395 and the collar stay 300 are shown for illustrative purposes and it is understood that these elements would not be visible from the outside in the actual product.

As shown, the opening 395 is formed in the outer surface 330 of the collar stand 300 and may be formed as a through opening that extends through all of the layers of material of the collar stand, or preferably, as a through opening that extends through some but not all of the layers of material of the collar stand 300. In the configuration of FIG. 7 where the opening 395 extends through some but not all of the layers of the collar stand 300, the second end 45 of the collar stay 35 may be inserted into the opening 395 so as to rest between the inner surface 320 and the outer surface 330 of the collar stand 300.

Although not shown, internal stitching or internal adhesive or bonding may be provided within the collar stand to define the outline of the collar stand receiving portion 310, including the second, opposing, closed end of the collar stand receiving portion. In this way, the collar stay will be guided through the opening 395 and into the limited area of the collar stand receiving portion 310. Alternatively, no additional stitching or bonding is provided so that the collar stay inserted into the opening 395 is not limited in the way that it can be angled or shifted within the collar stand 300.

A method of using the shirt collar locking apparatus and system 100 is also provided. The method includes providing the shirt collar locking apparatus and system 100, as described above. The method further includes inserting the first end 40 of the collar stay 35 into the shirt collar stay pocket 230 to the first shirt collar stay pocket end 232 and inserting the second end 45 of the collar stay 35 into the collar stand receiving portion 310 so as to couple the shirt collar 200 with the collar stand 300.

The present invention also involves a method of manufacturing a shirt that includes a collar stand and a shirt collar attached to the collar stand and also includes the shirt collar locking system and apparatus shown in FIGS. 3-8. The method includes the steps of providing a collar stand and a shirt collar and attaching the shirt collar to the collar stand at an upper portion of the collar stand, so that the inner side of the shirt collar faces an outer side of the collar stand when the shirt collar is in a folded down position relative to the collar stand. The method further includes a step of forming the shirt locking system by providing a shirt collar stay pocket on the inner side of the shirt collar and providing a collar stand receiving portion on the outer side of the collar stand. The configurations of the shirt collar stay pocket and of the collar stand receiving portion are as described above with respect to FIGS. 3-8. The method of manufacturing also includes providing or forming a shirt body, which is attached to the bottom edge of the collar stand using conventional techniques.

The above-described system and methods allow for the shirt collar to be attached to and locked relative to the collar stand using a conventional collar stay, which has a substantially planar stick-like shape. Since the system and methods of the invention do not require use of any other elements or locking mechanisms, the shirt collar can be locked relative to the collar stand using only the conventional stick-shaped collar stay inserted into the locking apparatus, without using any additional devices, such as shaping devices or further attachment mechanisms. Moreover, by attaching the shirt collar to the collar stand, instead of the body of the shirt, a neater appearance can be achieved where the shirt collar does not tug or pull on the body of the shirt due to the attachment and movement of the wearer. Moreover, attachment of the shirt collar to the collar stand can reduce the risk of visible damage to the body of the shirt because the collar stand typically includes multiple layers of material. Furthermore, the configuration and positioning of the shirt collar stay pocket and the collar stand receiving portion relative to one another provide for a simple configuration of the locking mechanism that can be used with conventional stick-shaped collar stays and does not require specially made collar stays. The positioning and orientation of the shirt collar stay pocket 230 and the collar stand receiving portion 310 also allow for insertion of the collar stay only into the shirt collar stay pocket without also inserting the collar stay into the collar stand receiving portion so that the collar stay can be retained in the shirt collar stay pocket and to allow versatility of wearing the shirt with or without a tie.

In all cases it is understood that the above-described arrangements are merely illustrative of the many possible specific embodiments which represent applications of the present invention. Numerous and varied other arrangements can be readily devised in accordance with the principles of the present invention without departing from the spirit and the scope of the invention.

What is claimed is:

1. A shirt collar locking system for locking a shirt collar in an upright position adapted for use with a standard planar stick-shaped collar stay having a first end and an opposing second end, the system comprising:

a shirt collar attached to a collar stand at an upper portion of the collar stand, an inner side of the shirt collar facing an outer side of the collar stand when the shirt collar is in a folded down position relative to the collar stand;

wherein:

the shirt collar includes a shirt collar stay pocket formed on the inner side of the shirt collar and configured to receive the first end of the collar stay so that the collar stay can be removably inserted into the shirt collar stay pocket, the collar stand includes a collar stand receiving portion formed on the outer side of the collar stand and configured to receive the opposing second end of the collar stay so as to lock the shirt collar to the collar stand, when the shirt collar is in a folded down position relative to the collar stand, a first end of the shirt collar stay pocket adapted for insertion of the first end of the collar stay is aligned with and proximate to a first end of the collar stand receiving portion adapted for insertion of the second end of the collar stay, and a second end of the collar stand receiving portion is closed.

2. The system according to claim 1, wherein the first end of the shirt collar stay pocket is disposed at a predetermined distance from an upper edge of the shirt collar attached to the upper portion of the collar stand, the predetermined distance being equal to or greater than a distance between the upper portion of the collar stand and the first end of the collar stand receiving portion.

3. The system according to claim 2, wherein the predetermined distance is substantially mid-way between the upper edge of the shirt collar and an opposing lower edge of the shirt collar.

4. The system according to claim 2, wherein a second end of the shirt collar stay pocket is disposed at a tip of the shirt collar.

5. The system according to claim 1, wherein one or more of:

the shirt collar stay pocket is separately formed from the shirt collar and is attached to the inner side of the shirt collar; and the collar stand receiving portion is separately formed from the collar stand and is attached to the outer ide of the collar stand.

6. The system according to claim 1, wherein:

shirt collar comprises two or more layers of material, and the shirt collar stay pocket includes an opening formed at the inner side of the shirt collar and extending through at least one layer of material, the opening forming the first end of the shirt collar stay pocket.

7. The system according to claim 1, wherein the collar stand receiving portion is formed as an elongated pocket with the first end of the collar stand receiving portion formed between a lower portion of the collar stand and the upper portion of the collar stand and the elongated pocket extending in a direction of the upper portion of the collar stand.

8. The system according to claim 1, wherein when the first end of the collar stay is inserted into the shirt collar stay pocket and the second end of the collar stay is inserted into the collar stand receiving portion, the shirt collar stay pocket and the collar stand receiving portion are oriented to be substantially linearly aligned with respect to one another.

9. The system according to claim 1, wherein the first end of the collar stand receiving portion is formed as a button hole on the outer side of the collar stand and extending through a portion of the collar stand thickness.

10. The system according to claim 1, wherein the collar stand is formed from two or more layers of material and the collar stand receiving portion is formed as an opening extending through at least an outermost layer of the collar stand.

11. The system according to claim 1, further comprising the standard planar stick-shaped collar stay wherein the first end of the collar stay is configured to be removably inserted into the first end of the shirt collar stay pocket and the second end of the collar stay is configured to be removably inserted into the first end of the collar stand receiving portion.

12. A method of manufacturing a shirt including a collar stand and a shirt collar attached to the collar stand and further including a shirt collar locking system for locking the shirt collar in an upright position adapted for use with a standard planar stick-shaped collar stay having a first end and an opposing second end, the method comprising:

providing a collar stand and a shirt collar;

attaching the shirt collar to the collar stand at an upper portion of the collar stand, an inner side of the shirt collar facing an outer side of the collar stand when the shirt collar is in a folded down position relative to the collar stand;

forming the shirt locking system by providing a shirt collar stay pocket on the inner side of the shirt collar and providing a collar stand receiving portion on the outer side of the collar stand, wherein the shirt collar stay pocket is configured to receive the first end of the collar stay so that the collar stay can be removably inserted into the shirt collar stay pocket and the collar stand receiving portion is configured to receive the opposing second end of the collar stay so as to lock the shirt collar to the collar stand, wherein when the shirt collar is in a folded down position relative to the collar stand, a first end of the shirt collar stay pocket adapted for insertion of the first end of the collar stay is aligned with and proximate to a first end of the collar stand receiving portion adapted for insertion of the second end of the collar stay, and wherein a second end of the collar stand receiving portion is closed.

13. The method according to claim 12, wherein the forming step comprises forming the first end of the shirt collar stay pocket at a predetermined distance from an upper edge of the shirt collar attached to the upper portion of the collar stand, the predetermined distance being equal to or greater than a distance between the upper portion of the collar stand and the first end of the collar stand receiving portion.

14. The method according to claim13, wherein the predetermined distance is substantially mid-way between the upper edge of the shirt collar and an opposing lower edge of the shirt collar.

15. The method according to claim 13, wherein a second end of the shirt collar stay pocket is disposed at a tip of the shirt collar.

16. The method according to claim 12, wherein one or more of:

(a) in the forming step, the shirt collar stay pocket is separately formed from the shirt collar and the forming step comprises attaching the shirt collar stay pocket to the inner side of the shirt collar; and (b) in the forming step, the collar stand receiving portion is separately formed from the collar stand and the forming step comprises attaching the collar stand receiving portion to the outer side of the collar stand.

17. The method according to claim 12, wherein:

the shirt collar comprises two or more layers of material, and the forming step comprises forming an opening at the inner side of the shirt collar to form the first end of the shirt collar stay pocket so that the opening extends through at least one of material of the shirt collar.

18. The method according to claim 12, wherein the forming step comprises forming the collar stand receiving portion as an elongated pocket with the first end of the collar stand receiving portion being formed between a lower portion of the collar stand and the upper portion of the collar stand and the elongated pocket extending in a direction of the upper portion of the collar stand.

19. The method according to claim 12, wherein in the forming step, the shirt collar stay pocket and the collar stand receiving portion are provided such that when the first end of the collar stay is inserted into the shirt collar stay pocket and the second end of the collar stay is inserted into the collar stand receiving portion, the shirt collar stay pocket and the collar stand receiving portion are oriented to be substantially linearly aligned with respect to one another.

20. The method according to claim 12, wherein the first end of the collar stand receiving portion is formed as a button hole on the outer side of the collar stand and extends through a portion of the collar stand thickness.

21. The method according to claim 12, wherein:

the collar stand is formed from two or more layers of material; and the forming step comprises forming an opening in the collar stand to form the first end of the collar stand receiving portion, wherein the opening extends through at least an outermost layer of the collar stand.

22. The method according to claim 12, further comprising inserting the first end of the standard planar stick-shaped collar stay into the first end of the shirt collar stay pocket without permanently attaching the first end of the collar stay to the shirt collar, wherein the second end of the collar stay is configured to be removably inserted into the first end of the collar stand receiving portion.

* * * * *